US006637225B1

(12) United States Patent
Cho et al.

(10) Patent No.: US 6,637,225 B1
(45) Date of Patent: Oct. 28, 2003

(54) CONCENTRATED COOLING APPARATUS AND REFRIGERATOR HAVING THE SAME

(75) Inventors: Seong-Ho Cho, Seoul (KR); In-Seop Lee, Euiwang (KR); In-Won Lee, Gwangmyeong (KR); Jae-Yong Sung, Seoul (KR); Jay-Ho Choi, Seoul (KR); Kwang-Hyup An, Seoul (KR); Jeong-Ho Lee, Goyang (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/289,413

(22) Filed: Nov. 7, 2002

(30) Foreign Application Priority Data

Jul. 26, 2002 (KR) ..... 2002-0044337

(51) Int. Cl.[7] ..... F25D 17/04; F25D 17/06
(52) U.S. Cl. ..... 62/186; 62/414; 236/49.3
(58) Field of Search ..... 62/186, 414, 413, 62/404, 89, 255; 236/49.3; 454/108, 154, 305

(56) References Cited

U.S. PATENT DOCUMENTS 4,912,943 A * 4/1990 Hubert et al. ..... 62/374
5,737,935 A * 4/1998 Heo ..... 62/186
5,775,124 A * 7/1998 Park et al. ..... 62/408
5,778,688 A * 7/1998 Park et al. ..... 62/89
5,907,953 A * 6/1999 Kang et al. ..... 62/89
6,055,820 A * 5/2000 Jeong et al. ..... 62/186

* cited by examiner

*Primary Examiner*—Marc Norman
(74) *Attorney, Agent, or Firm*—Birch, Stewart, Kolasch & Birch, LLP

(57) ABSTRACT

In a concentrated cooling apparatus and a refrigerator having the same capable of performing cooling operation instantly by discharging intensively cold air to a high-temperature load occurred region inside a chilling chamber, a concentrated cooling apparatus of a refrigerator includes housings respectively installed to at least one cold air guide path formed at the side wall of a chilling chamber in order to guide cold air to the side wall of the chilling chamber; a nozzle rotatively supported by the housings and jetting cold air intensively to a high-temperature load occurred region inside the chilling chamber when the high temperature load occurs at the certain region; a temperature sensor installed on the front of the nozzle, rotating with the nozzle and sensing the high-temperature load occurred region; and a nozzle driving unit installed at a certain side of the housings to rotate the nozzle.

22 Claims, 8 Drawing Sheets

CONCENTRATED COOLING APPARATUS AND REFRIGERATOR HAVING THE SAME

This nonprovisional application claims priority under 35 U.S.C. §119(a) on Patent Application No. 2002-0044337 filed in KOREA on Jul. 26, 2002, which is herein incorporated by reference.

BACKGROUND OF THE INVENTION

1. Field of the Invention

The present invention relates to a refrigerator, and in particular to a concentrated cooling apparatus and a refrigerator having the same capable of performing instant cooling operation and maintaining a temperature inside a cooling chamber uniformly by jetting cold air intensively at a high-temperature load occurred region inside the chilling chamber.

2. Description of the Prior Art

In general, a refrigerator is partitioned into a freezing chamber for storing is frozen food and a chilling chamber for storing cold food, and it has a refrigerating cycle for supplying cold air into the freezing chamber and the chilling chamber.

FIG. 1 is a perspective-sectional view illustrating the conventional refrigerator, and FIG. 2 is a sectional view illustrating a chilling chamber of the conventional refrigerator.

The conventional refrigerator consists of a main body 104 having a pair of doors 102; a freezing chamber 106 placed on the left of the main body 104 and storing frozen food; a chilling chamber 108 partitioned from the freezing chamber 106 by a separation wall 110, placed on the right side of the main body 104 and having plural shelves 114 for putting cold food; and a cold air supply unit supplied air cooled while passing the refrigerating cycle (not shown) to the freezing chamber 106 and the cooling chamber 108.

The cold air supply unit includes a blower 120 installed at the upper rear surface of the freezing chamber 106 and forcibly ventilating air cooled while passing the refrigerating cycle; a panel 128 installed at the lower portion of the blower 120 and having plural cold air discharge holes 130 for discharging cold air inside the freezing chamber 106; a cold air supply path 132 formed at the upper portion of the separation wall 110 in order to make the cold air ventilated from the blower 120 flow into the chilling chamber 108; a cold air discharge duct 134 installed at the upper portion of the chilling chamber 108, communicating with the cold air supply path 132 and discharging the air supplied from the cold air supply path 132 into the chilling chamber 108; and a cold air inflow path 138 formed at the lower portion of the separation wall 110 and making the cold air finishing the cooling operation while circulating the chilling chamber 108 flow into the refrigerating cycle.

Herein, plural cold air discharge holes 136 for discharging cold air into the chilling chamber 108 are formed at the front and lower surfaces of the cold air discharge duct 134.

And, a temperature sensor 140 is installed at a certain side of the chilling chamber 108, when a temperature inside the chilling chamber 108 is not greater than a set value, cold air supply into the chilling chamber 108 is stopped, when a temperature inside the chilling chamber 108 is not less than a set value, cold air is supplied into the chilling chamber 108.

In the conventional refrigerator, when the refrigerating cycle is operated and the blower 120 is circulated, cold air cooled while passing the refrigerating cycle is respectively discharged into cold air discharge holes 230 of a panel 128 and the cold air supply path 132 by the ventilation pressure of the blower 120.

The cold air discharged into the cold air discharge holes 130 performs the cooling operation of frozen food stored in the freezing chamber 106 while circulating inside the freezing chamber 106.

And, the cold air supplied to the cold air supply path 132 flows into the cold air discharge duct 134 and is discharged into the chilling chamber 108 through cold air discharge holes 136 formed on the cold air discharge duct 134. The cold air discharged into the chilling chamber 108 performs the cooling operation of cold food stored in the chilling chamber 108 while circulating inside the chilling chamber 108, and the cold air finishing the cooling operation flows into the cold air inflow path 138 formed at the lower portion of the separation wall 110 and is cooled again while passing the refrigerating cycle.

However, in the conventional refrigerator, a cold air discharge duct is installed at the upper portion of a chilling chamber, cold air is supplied from the upper portion to the lower portion of the chilling chamber through cold air discharge holes formed on the cold air discharge duct, a temperature variation inside the chilling chamber is big according to a distance from the cold air discharge holes. And, because cold air is discharged only from the cold air discharge duct, when a high temperature load occurs due to foodstuff stored inside the chilling chamber, etc., lots of time is required for equalizing a temperature inside the chilling chamber, and freshness of the foodstuff stored in the chilling chamber may be lowered due to delay in cooling.

In addition, because a temperature sensor and cold air discharge holes are fixed at a certain region, there are some difficulties to detect a temperature of a certain portions of the chilling chamber through the temperature sensor and cold air are discharged onto only limited region, herein, when a load occurs on the certain regions, lots of time is required for solving the temperature variation, and accordingly a temperature inside the chilling chamber may not be uniformly maintained.

In particular, because the cold air discharge holes are formed at the rear of the chilling chamber, cold air supply is concentrated on the rear and center portions of the chilling chamber around the cold air discharge holes, foodstuff stored on that portions may be excessively cooled, in addition, foodstuff stored on portions separated from the cold air discharge holes may be weakly cooled.

In more detail, the temperature variation inside the chilling chamber is big according to a distance from the cold air discharge holes, and accordingly a temperature distribution inside the chilling chamber may not be uniform.

SUMMARY OF THE INVENTION

In order to solve the above-mentioned problems, it is an object of the present invention to provide a concentrated cooling apparatus and a refrigerator having the same capable of equalizing a temperature variation inside a chilling chamber instantly by installing a concentrated cooling apparatus inside the chilling chamber and discharging cold air intensively on a high-temperature load occurred region inside the chilling chamber and maintaining freshness of foodstuff stored in the chilling chamber by improving a cooling speed on the high-temperature load occurred region.

In order to achieve the above-mentioned object, a concentrated cooling apparatus of a refrigerator in accordance with the present invention includes housings respectively installed to at least one cold air guide path formed at the side wall of a chilling chamber in order to guide cold air to the side wall of the chilling chamber; a nozzle rotatively supported by the housings and jetting cold air intensively to a high-temperature load occurred region inside the chilling chamber; a temperature sensor installed on the front of the nozzle rotating with the nozzle and sensing the high-temperature load occurred region; and a nozzle driving unit installed at a certain side of the housings to rotate the nozzle.

The housing installed a cold air guide hole formed on the cold air guide path so as to communicate with each other, and the other housing is an cover installed to the open upper surface of the housing so as to expose the nozzle to the front thereof.

The housing having a contact protrusion is inwardly formed from the bottom central portion of the housing so as to contact with the nozzle, and plural first support rollers are installed at the circumference of the contact protrusion to support the nozzle rotatively.

A first hot wire is installed on the inner circumference of the contact protrusion to prevent frozen over on the contact portion with the nozzle.

The cover is formed a insert hole for receiving the nozzle rotatively, and plural second support rollers are installed at the lower surface of the cover to support the nozzle rotatively.

A second hot wire is installed on the lower surface of the cover to prevent frozen over on the portion contacted to the nozzle.

The nozzle is inserted into the nozzle insertion hole of the lower housing, the upper portion thereof is exposed to the inside of the chilling chamber, and the lower surface is rotatively contacted to the outer circumference of the contact protrusion of the lower housing, a cold air jet hole for jetting cold air into the chilling chamber is formed on the nozzle so as to be eccentric as a certain degree from the upper surface of the nozzle, and a insert groove for receiving the temperature sensor is formed on the upper surface of the nozzle.

The upper surface of the nozzle exposed to the chilling chamber is a semi-globular shape.

The upper surface of the nozzle exposed to the chilling chamber is a flat shape.

The cold air jet hole is slant at a certain angle to the lower central surface of the nozzle, and an inlet thereof for discharging cold air is formed so as to be eccentric to the center of the nozzle to a certain side.

The insert groove has a certain slant angle to make the temperature sensor slant to the upper surface of the nozzle at a certain angle.

The temperature sensor is an infrared sensor sensing a temperature by receiving infrared light radiated from a heat source at the front of the cold air jet hole.

The nozzle driving unit includes a gear box installed at the side of the housing and combining plural gears; a driving motor disposed in the hear box and generating a driving force; and a nozzle supporting member connected to the nozzle by a connection rod and transmitting the driving force of the driving motor by being engaged with a driving shaft of the driving motor and plural gears.

The driving motor is a stepping motor.

The nozzle supporting member consists of a disc portion at which the gear and a gear teethare formed at the outer circumference; and a cylinder portion vertically extended from the disc portion, having the connection rod and rotatively supported by contacting to the second support roller.

A refrigerator having a concentrated cooling apparatus in accordance with the present invention includes a cold air supply path formed at the rear of a chilling chamber and supplying air ventilated by a blower; a cold air discharge duct installed at the upper portion of the chilling chamber and having plural cold air discharge holes communicating with the cold air supply path to discharge cold air into the chilling chamber; plural cold air guide paths formed at the side wall of the chilling chamber so as to communicate with the cold air supply path in order to guide cold air to the side wall of the chilling chamber; a nozzle rotatively installed at each cold air guide hole formed at the cold air guide paths respectively and jetting cold air intensively to a high-temperature load occurred region; a temperature sensor installed at the front of the nozzle and sensing a hightemperature load occurred region while rotating with the nozzle; and a nozzle driving unit for rotating the nozzle.

A damper is installed on the cold air supply path in order to open/close cold air flowing into the chilling chamber and open/close cold air supply to the cold air discharge duct.

The damper is rotatively installed on the upper surface of the cold air supply path by a hinge shaft, and the hinge shaft is connected to a driving unit.

Each nozzle is vertically installed at the left wall of the chilling chamber at regular intervals.

Each nozzle is vertically installed at the right wall of the chilling chamber at regular intervals.

Each nozzle is vertically installed at the left and right walls of the chilling chamber at regular intervals.

Each nozzle is installed at a portion on the side wall of the chilling chamber near to a door.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a refrigerator having a concentrated cooling apparatus in accordance with the present invention will be described with reference to accompanying drawings.

There can be plural embodiments of a refrigerator having a concentrated cooling apparatus in accordance with the present invention, hereinafter, the preferred embodiment will be described.

Figure 1:
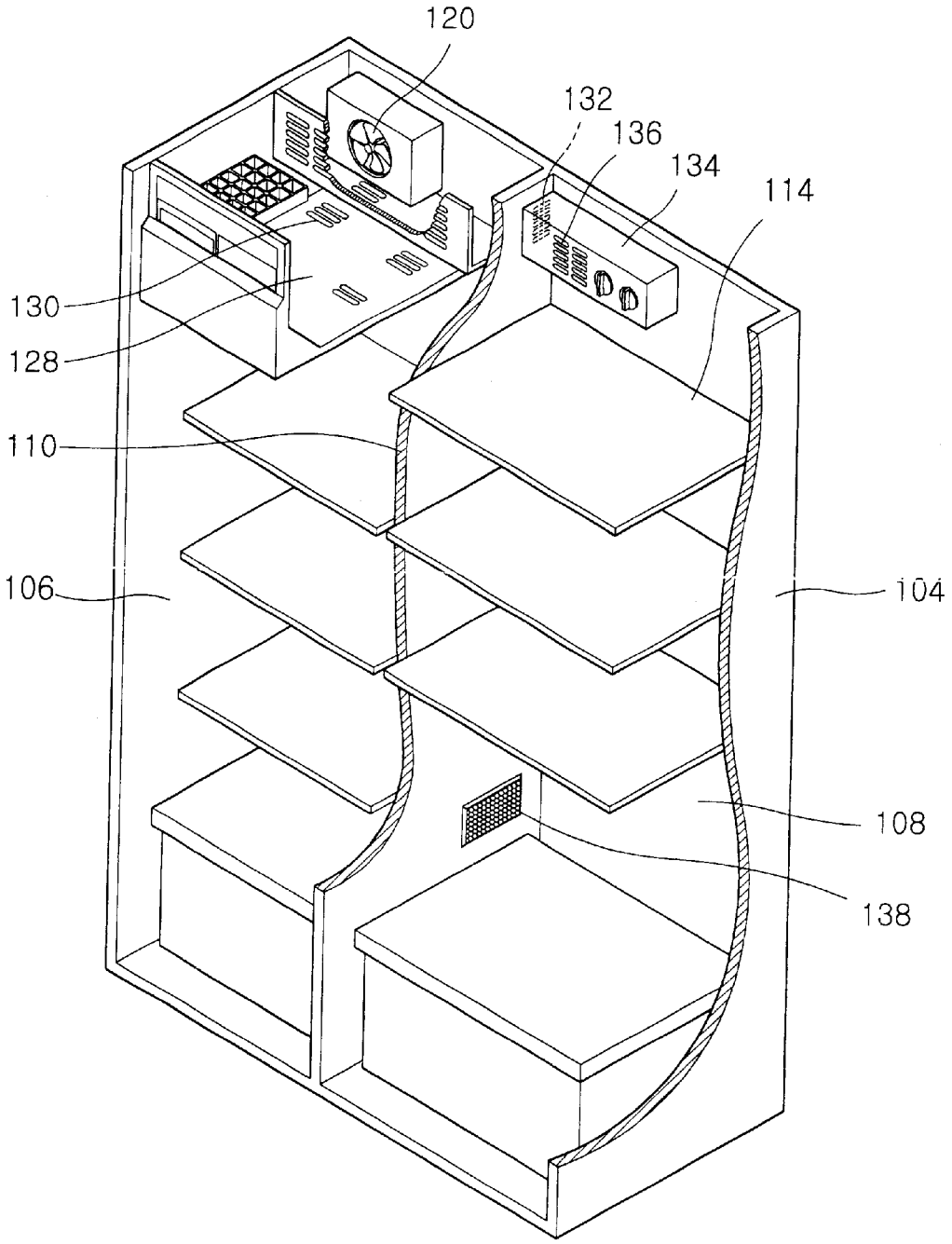
FIG. 1 CONVENTIONAL ART
FIG. 1 is a perspective-sectional view illustrating the conventional refrigerator.
Figure 2:
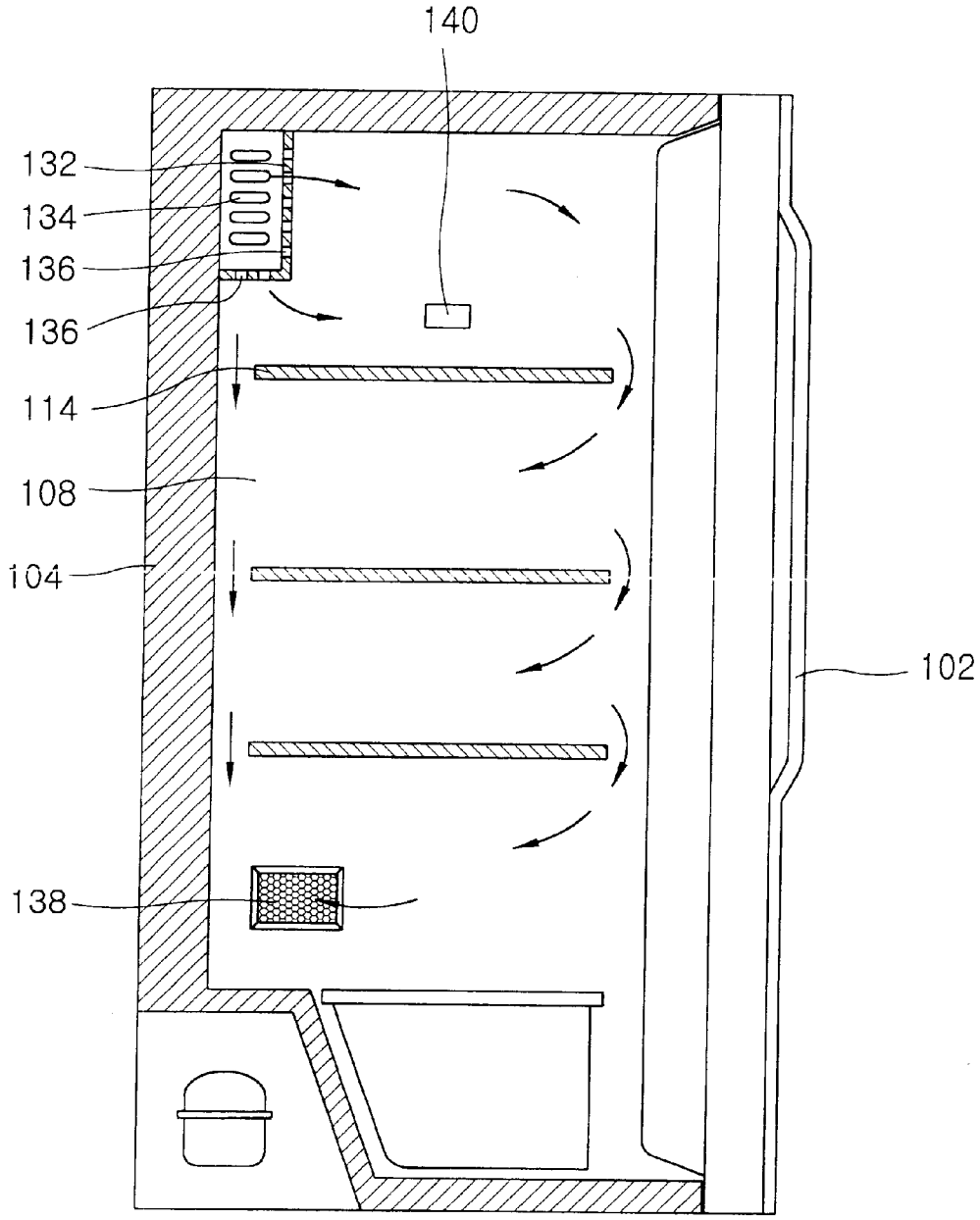
FIG. 2 CONVENTIONAL ART
FIG. 2 is a sectional view illustrating a chilling chamber of the conventional refrigerator.
Figure 3:
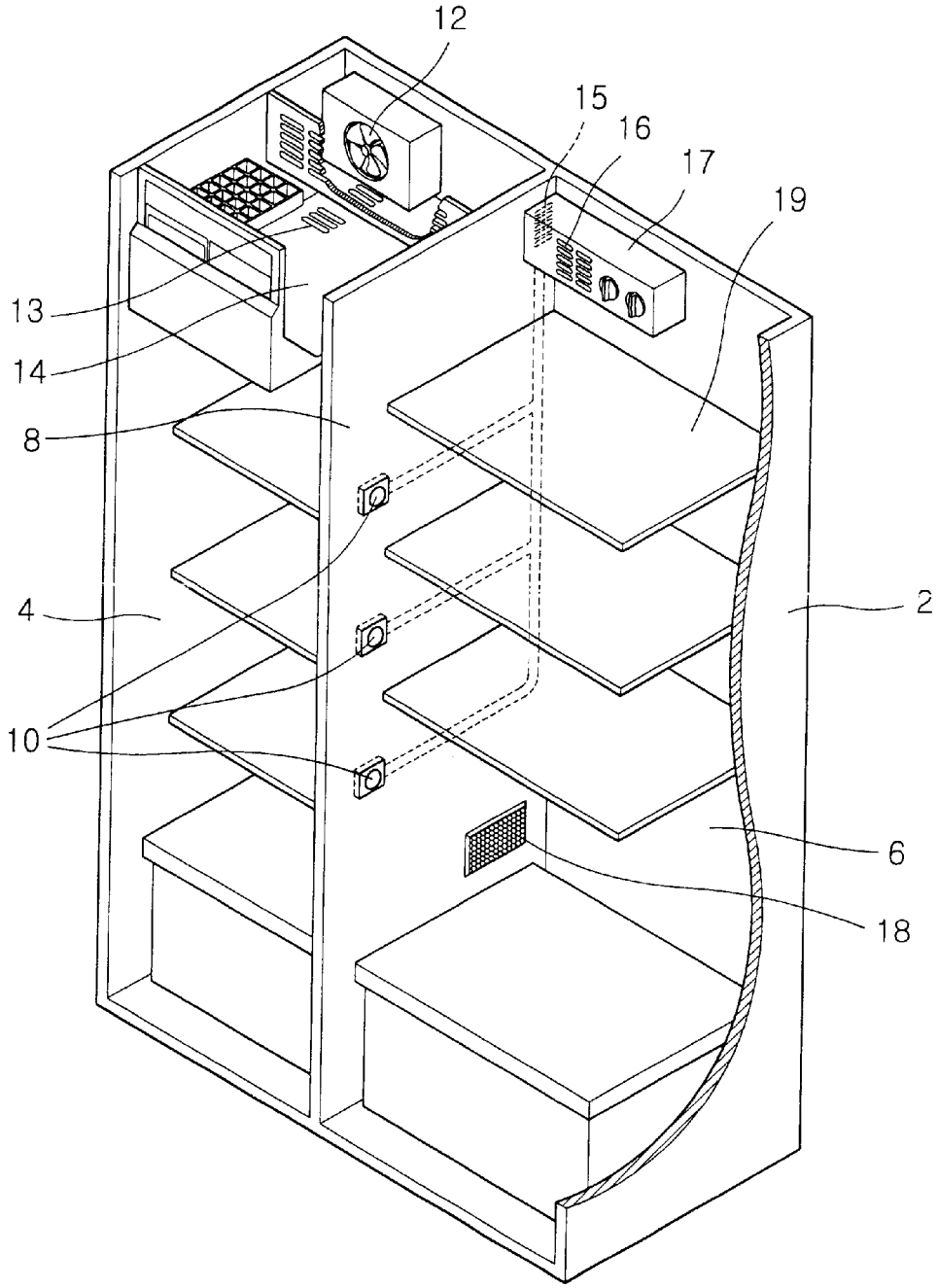
FIG. 3 is a perspective-sectional view illustrating a refrigerator having a concentrated cooling apparatus in accordance with the present invention.

FIG. 3 is a perspective-sectional view illustrating a refrigerator having a concentrated cooling apparatus in accordance with the present invention.

The refrigerator in accordance with the present invention includes a main body 2 on which a door (not shown) open/closed in two ways installed on the front; a freezing chamber 4 placed on the left or right of the main body 2 and storing frozen food; a chilling chamber 6 partitioned from the freezing chamber 4 by a separation wall 8 and storing cold food; a refrigerating cycle (not shown) installed at a certain side of the main body 2 and generating cold air; a cold air supply unit for supplying air cooled while passing the refrigerating cycle to the freezing chamber 4 and the cooling chamber 6; and a concentrated cooling apparatus, etc. for jetting cold air intensively to a high-temperature load occurred region.

The cold air supply unit includes a blower 12 installed at the upper rear surface of the freezing chamber 4 and forcibly ventilating air cooled while passing the refrigerating cycle; a panel 14 installed at the lower portion of the blower 12 and having plural discharge holes 13 for discharging cold air from the blower 12 into the freezing chamber 4; a cold air supply path 15 formed at the upper portion of the separation wall 8; and a cold air discharge duct 17 installed at the upper portion of the chilling chamber 6, communicating with the cold air supply path 15 and having cold air discharge holes 16 for discharging cold air into the chilling chamber 6.

And, a cold air inflow path 18 is formed at the lower portion of the separation wall 8 to make the cold air finishing the cooling operation while circulating the chilling chamber 6 flow into the refrigerating cycle.

The concentrated cooling apparatus consists of at least one cold air guide path 19 extended from the cold air supply path 15 and formed at a side wall of the chilling chamber 6 in order to guide cold air to the side wall of the chilling chamber 6; and each cold air jet unit 10 connected to the cold air guide path, respectively installed at the side walls of the chilling chamber 6 and jetting cold air to the high-temperature load occurred region.

A damper 20 is installed on the cold air supply path 15 in order to open/cut cold air flowing into the chilling chamber 6 or open/close the cold air supply duct 17 and the cold air guide path 19 selectively.

The damper 20 has a disc shape and is rotatively installed at the upper side surface of the cold air supply path 15 by a hinge shaft 22. And, the hinge shaft 22 is connected to a driving unit (not shown), when the driving unit 22 is operated, the damper 20 is rotated.

Figure 4:
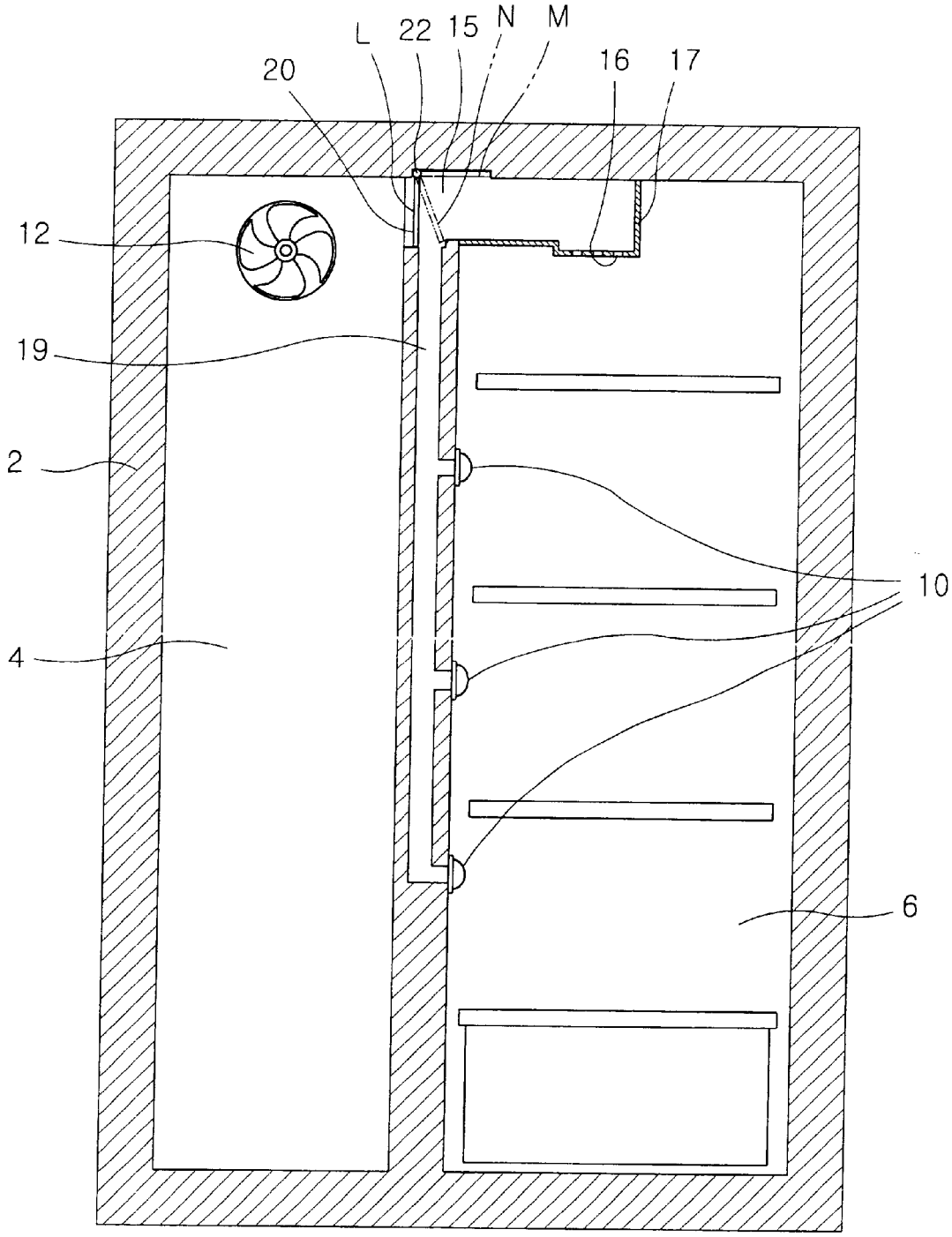
FIG. 4 is a sectional view illustrating the refrigerator having the concentrated cooling apparatus in accordance with the present invention.

In more detail, as depicted in FIG. 4, by the operation of the driving unit, when the damper 20 is placed on a first position (L), cold air supply to the chilling chamber 6 is cut off, when the damper 20 is placed on a second position (M), cold air supply to the cold air discharge duct 17 is cut off, when the damper 20 is placed on a third position (N), cold air is supplied to the cold air guide path 19 and the cold air discharge duct 17.

Figure 5:
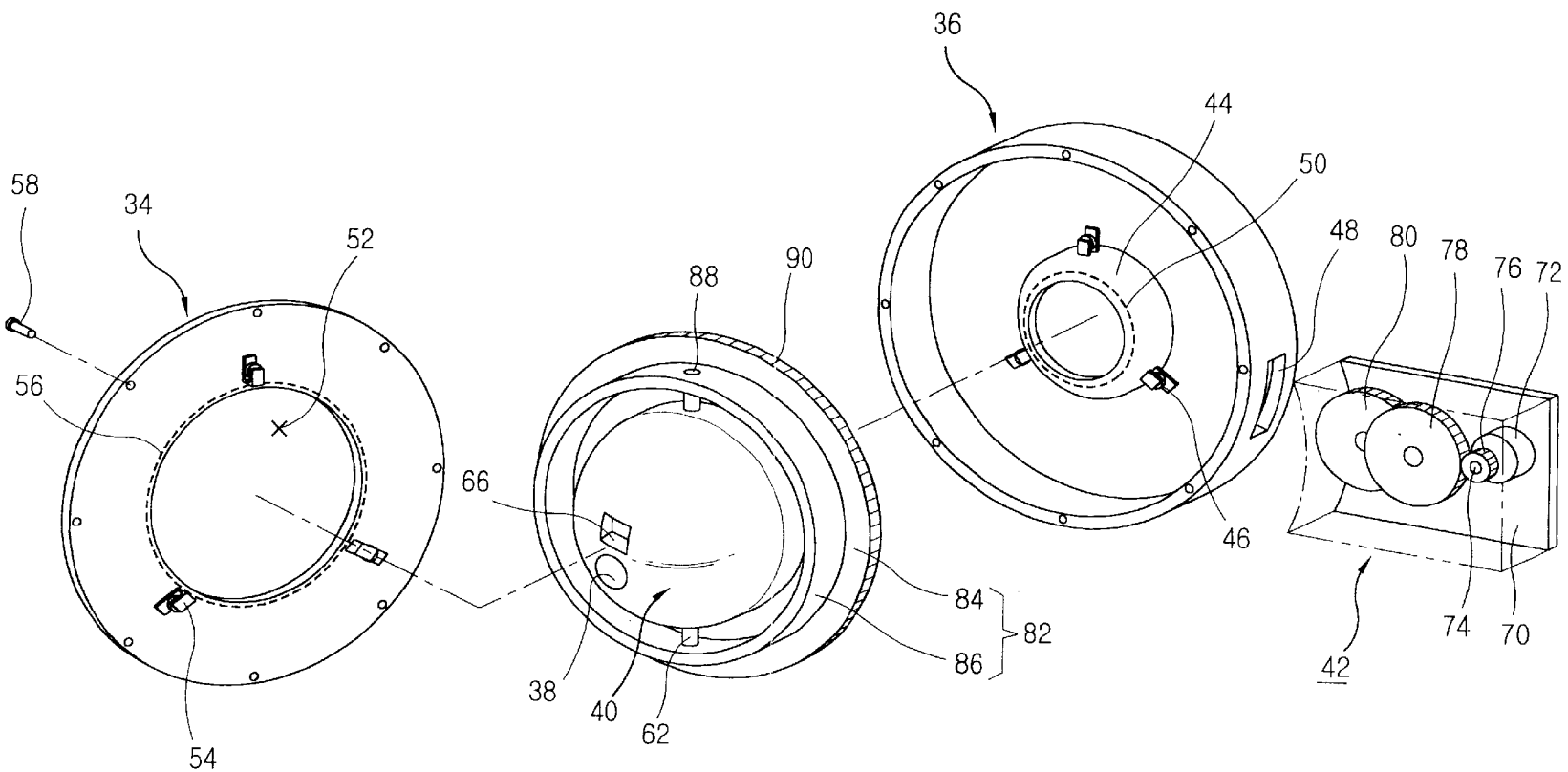
FIG. 5 is a perspective-sectional view illustrating the concentrated cooling apparatus in accordance with the present invention.
Figure 6:
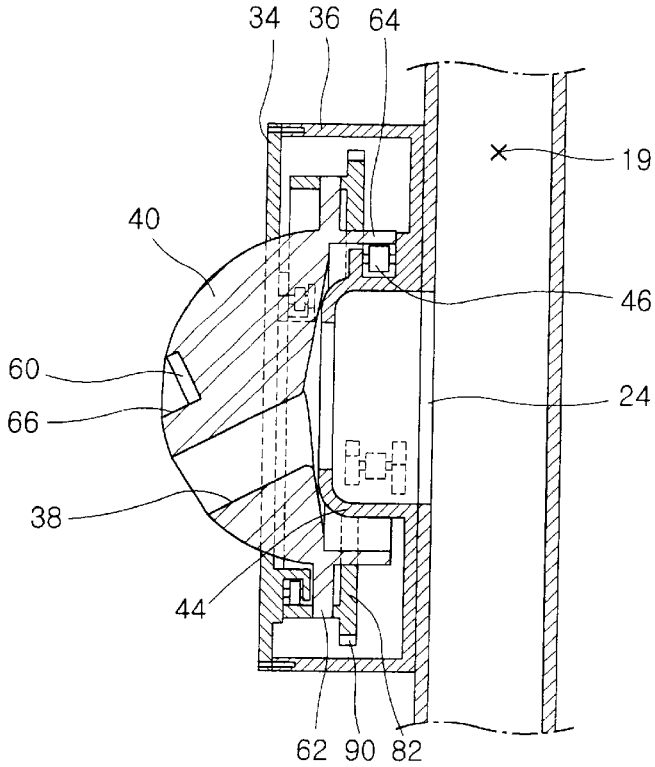
FIG. 6 is a sectional view illustrating the concentrated cooling apparatus in accordance with the present invention.

FIG. 5 is a perspective-sectional view illustrating the cold air jetting unit in accordance with the present invention, and FIG. 6 is a sectional view illustrating the cold air jetting unit in accordance with the present invention.

The cold air jet unit 10 includes housings 34, 36 respectively installed on the cold air guide path 19 at regular intervals; a nozzle 40 rotatively supported by the housings 34, 36 and jetting cold air to the high-temperature load occurred region; a temperature sensor 60 installed on the front of the nozzle 40, rotating with the nozzle 40 and sensing the high-temperature load occurred region inside the chilling chamber 6; and a nozzle driving unit 42 for rotating the nozzle 40.

The housing 36 installed each cold air guide hole 24 formed on the cold air guide path 19, and a cover 34 installed on the open upper surface of the housing 36.

Figure 7:
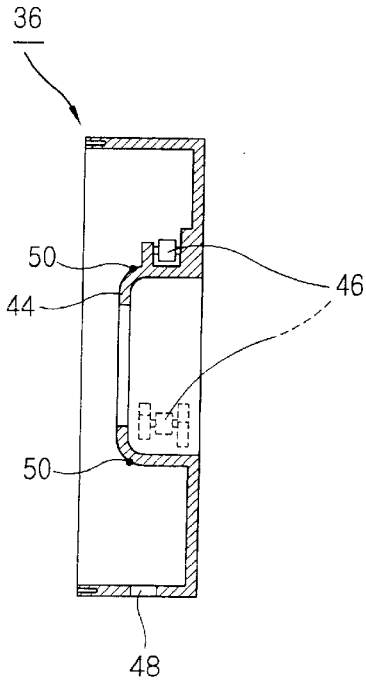
FIGS. 7~9 are sectional views illustrating a structure of each part of the concentrated cooling apparatus in accordance with the present invention.

Herein, as depicted in FIG. 7, in the housing 36 having the cylindrical shape, the upper portion is open, a contact protrusion 44 is formed from the bottom central portion inwardlly so as to contact with the nozzle 40, and plural first support rollers 46 for rotatively supporting the nozzle 40 are installed at the circumference of the contact protrusion 44 at regular intervals. And, the nozzle driving unit 42 is installed at the side of the housing 36, and a gear insertion hole 48 for inserting a gear of the nozzle driving unit 42 is formed at the side of the housing 36.

Herein, the contact protrusion 44 communicates with the cold air guide hole 24 of the cold air guide path 19, the upper surface of the contact protrusion 44 is a curved shape so as to facilitate the rotation in the contact state with the nozzle 40, a first hot wire 50 is installed on the circumference of the contact protrusion 44, and accordingly it is possible to prevent frozen over on the contact portion between the nozzle 40 and the contact protrusion 44.

It is preferable to form the first hot wire 50 as a film type heater installed on the inner circumference of the contact protrusion 44, when power is applied, by heating the contact protrusion 44, frozen over on the contact portion between the nozzle 40 and the contact protrusion 44 due to the cold air discharged into the chilling chamber 6 can be prevented.

Figure 8:
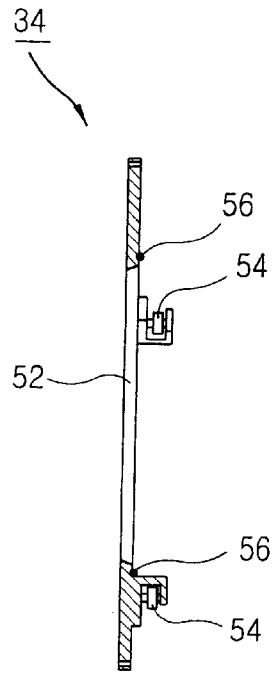

As depicted in FIG. 8, in the cover 34 having a nozzle insertion hole 52 for inserting the nozzle 40 is formed at the central portion, and plural second support rollers 54 are installed at the lower surface of the cover 34 in the circumferential direction of the nozzle insertion hole 42 at regular intervals. And, a second hot wire 56 is installed on the internal surface of the cover 34 in the circumferential direction, and accordingly it is possible to prevent frozen over on the portion contacted to the nozzle 40.

Herein, it is preferable to form the second hot wire 56 as a film type heater, when power is applied, it heats the cover 34. And, the housing 36 and the cover 34 are combined with each other by bolts 58.

Figure 9:
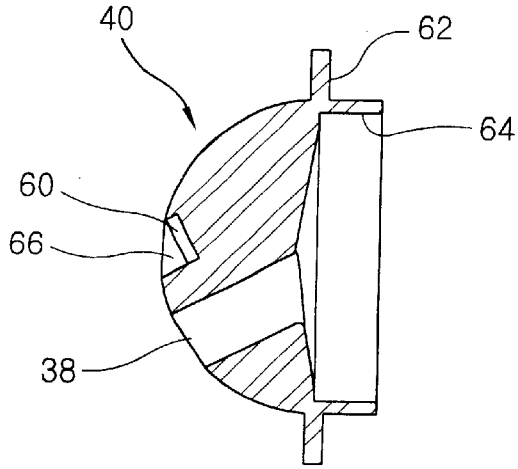

As depicted in FIG. 9, the nozzle 40 has a semi-globular shape, is inserted into the nozzle insertion hole 52 of the cover 34, the upper portion the nozzle 40 is exposed to the front of the cover 34, and the lower inner circumference of the nozzle 40 is contacted to the contact protrusion 44 of the housing 36.

And, a cold air jet hole 38 for jetting cold air into the chilling chamber 6 is formed at a portion eccentric to the center of the nozzle 40, and a temperature sensor 60 for detecting a temperature inside the chilling chamber 6 is installed on the upper surface of the nozzle 40. And, a connection rod 62 is formed at the lower portion of the nozzle 40 as one body so as to be connected with the nozzle driving unit 42, and a cylindrical guide portion 64 rotatively supported by the first support roller 46 of the housing 36 is formed at the lower portion of the nozzle 40.

Herein, the cold air jet hole 38 is slant at a certain angle to the bottom center surface of the nozzle 40, and an inlet thereof for discharging cold air is formed at a portion eccentric to the center of the nozzle 40.

And, the temperature sensor 60 is installed at a insert groove 66 formed at the eccentric portion of the nozzle 40, it is preferable to construct the temperature sensor as an infrared sensor sensing a temperature by receiving infrared light radiated from the heat source of the front of the cold air jet hole 38.

Figure 10:
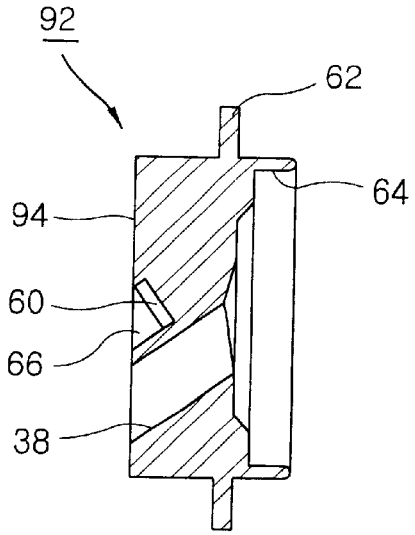
FIG. 10 is a sectional view illustrating another embodiment of a nozzle of the concentrated cooling apparatus in accordance with the present invention.

FIG. 10 is a sectional view illustrating another embodiment of a nozzle of the concentrated cooling apparatus in accordance with the present invention.

A nozzle 92 in accordance with another embodiment of the present invention has the same structure as that of the nozzle of the first embodiment. Only, the upper surface 94 exposed to the front of the cover 34 is flat.

In more detail, the nozzle 92 is inserted into the nozzle insertion hole 52 of the cover 34, the upper portion exposed to the front of the cover 34 is flat, the cold air jet hole 38 is formed eccentrically, and the temperature sensor 60 is installed at the insert groove 66 formed at the side of the upper surface so as to be slant at a certain angle.

The nozzle driving unit 42 includes a gear box 70 installed at the side of the housing 36; a driving motor 72 disposed in the gear box 70 and generating a driving force; and a nozzle supporting member 82 fixed by the connection rod 62 of the nozzle 40 and connected to the driving motor 72 by plural gears so as to transmit the driving force of the driving motor 72 to the nozzle 40.

It is preferable to use a stepping motor rotated at a certain step angle as the driving motor 72.

Figure 11:
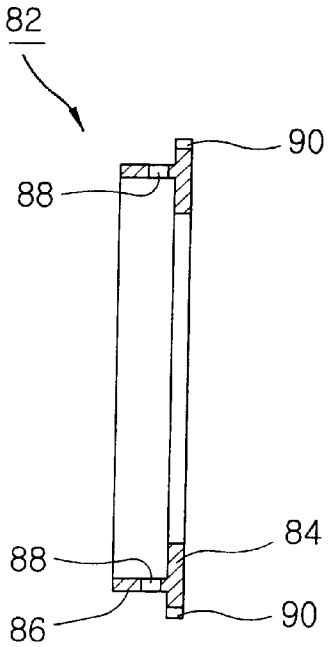
FIG. 11 is a sectional view illustrating a nozzle supporting member of the concentrated cooling apparatus in accordance with the present invention.

As depicted in FIG. 11, the nozzle supporting member 82 consists of an disc portion 84 so as to receive the outer circumference of the guide portion 64 of the nozzle 40; and a cylinder portion 86 vertically extended from the disc portion 84 and having an installation hole 88 for receiving the connection rod 62.

Herein, a gear teeth 90 engaged with the gear is formed at the outer circumference of the disc portion 84, and the inner circumference of the cylinder unit 86 is contacted with the second guide roller 54 installed on the cover 34 and is rotatively supported.

The gear consists of a first gear 76 fixed at the driving shaft 74 of the driving motor 72; a second gear 78 engaged with the first gear 76; and a third gear 80 engaged with the second gear 78, passing the gear insertion hole 48 formed at the housing 36 and engaged with the gear teeth 90 of the nozzle supporting member 82.

The operation of the refrigerator having the cold air jet unit in accordance with the embodiment of the present invention will be described.

When the refrigerating cycle and the blower 20 are operated, air cooled while passing the refrigerating cycle is discharged into the freezing chamber 4 through the cold air discharge hole 13 formed at the panel 14 and performs the cooling operation by circulating the freezing chamber 4 and is supplied to the chilling chamber 6 through the cold air supply path 15 formed at the separation wall 8.

The cold air supplied to the cold air supply path 15 flows into the cold air guide path 19, is discharged into the chilling chamber 6 through the cold air discharge holes 16 formed on the cold air discharge duct 17 and performs the cooling operation. Herein, the damper 20 installed on the cold air supply path 15 is operated at the third position (N), and accordingly the cold air is discharged into the chilling chamber 6.

In the operation, when a high-temperature load occurs inside the chilling chamber 6, the damper 20 is operated at the second position (M), cold air supply to the cold air discharge duct 17 is cut off, cold air is supplied only to the cold air guide duct 19, the cold air jet unit is operated, and cold air is intensively jetted onto the high-temperature load occurred region.

In more detail, when the driving motor 72 is operated, the driving force of the driving motor 72 is decelerated as a certain degree by the combination of first, second and third gears 76, 78, 80 and rotates the nozzle supporting member 82 engaged with the third gear 80, and the nozzle 40 connected with the nozzle supporting member 82 by the connection rod 62 is rotated. Herein, the temperature sensor 60 installed on the front of the nozzle 40 scans a temperature inside the chilling chamber 6, senses the high-temperature load occurred region and applies it to a control unit (not shown). The control unit controls the driving motor 72 to make the cold air jet hole 38 of the nozzle 40 rotate toward the pertinent region, the concentrated cooling is performed on the high-temperature load occurred region, and accordingly a temperature inside the chilling chamber 6 can be instantly equalized.

Herein, by the first support rollers 46 installed at the housing 36, the nozzle support member 82 is rotatively supported, by the second support rollers 54 installed at the cover 34, the nozzle is rotatively supported.

And, by the operation of the first hot wire 50 installed on the contact protrusion 44 of the housing 36, frozen over on the contact portion between the nozzle support member 82 and the housing 36 can be prevented, and by the operation of the second hot wire 56 installed on the cover 34, frozen over on the contact portion between the nozzle 40 and the cover 34 due to cold air can be prevented.

Advantageous of the present invention will be described.

By rotatively installing a nozzle having plural cold air jet holes at the side wall of a chilling chamber and installing a temperature sensor on the nozzle and scanning a temperature inside every portion of the chilling chamber by rotating the nozzle, when a high-temperature load is detected at a certain region, by adjusting a jet position of the nozzle jet holes by rotating the nozzle, cold air can be intensively discharged onto the high-temperature load occurred region, cooling operation can be instantly performed, and accordingly a temperature inside the chilling chamber can be uniformly maintained.

What is claimed is:

1. A concentrated cooling apparatus of a refrigerator, comprising:

a housing respectively installed to at least one cold air guide path formed at the side wall of a chilling chamber in order to guide cold air to the side wall of the chilling chamber;

a nozzle rotatively supported by the housings and jetting cold air intensively to a high-temperature load occurred region inside the chilling chamber;

a temperature sensor installed on the front of the nozzle, rotating with the nozzle and sensing the high-temperature load occurred region; and a nozzle driving unit installed at a certain side of the housings to rotate the nozzle.

2. The apparatus of claim 1, wherein the housings installed to a cold air guide hole formed on the cold air guide path so as to communicate with each other, and a cover installed to the open upper surface of the housing so as to expose the nozzle to the front thereof.

3. The apparatus of claim 2, wherein the housing having a contact protrusion is inwardly formed from the bottom central portion of the housing so as to contact with the nozzle, and plural first support rollers are installed at the circumference of the contact protrusion to support the nozzle rotatively.

4. The apparatus of claim 3, wherein a first hot wire is installed on the inner circumference of the contact protrusion to prevent frozen over on the contact portion with the nozzle.

5. The apparatus of claim 2, wherein the cover is formed as a disc shape having a insert hole for receiving the nozzle rotatively, and plural second support rollers are installed at the lower surface of the cover to support the nozzle rotatively.

6. The apparatus of claim 1, wherein a second hot wire is installed on the lower surface of the coverto prevent frozen over on the portion contacted to the nozzle.

7. The apparatus of claim 1, wherein the nozzle is inserted into the nozzle insertion hole of the lower housing, the upper portion thereof is exposed to the inside of the chilling chamber, and the lower surface of the nozzle is rotatively contacted to the outer circumference of the contact protrusion of the lower housing, a cold air jet hole for jetting cold air into the chilling chamber is formed on the nozzle, and a insert groove for receiving the temperature sensor is formed on the upper surface of the nozzle.

8. The apparatus of claim 7, wherein the upper surface of the nozzle exposed to the chilling chamber is a semi-globular shape.

9. The apparatus of claim 7, wherein the upper surface of the nozzle, exposed to the chilling chamber is a flat shape.

10. The apparatus of claim 7, wherein the cold air jet hole is slant at a certain angle to the lower central surface of the nozzle, and an inlet thereof for discharging cold air is formed so as to be eccentric to the center of the nozzle to a certain side.

11. The apparatus of claim 7, wherein the insert groove has a certain slant angle to make the temperature sensor slant to the upper surface of the nozzle at a certain angle.

12. The apparatus of claim 7, wherein the temperature sensor is an infrared sensor sensing a temperature by receiving infrared light radiated from a heat source at the front of the cold air jet hole.

13. The apparatus of claim 1, wherein the nozzle driving unit includes:

a gear box installed at the side of the housing and combining plural gears;

a driving motor disposed in the hear box and generating a driving force; and a nozzle supporting member connected to the nozzle by a connection rod and transmitting the driving force of the driving motor by being engaged with a driving shaft of the driving motor and plural gears.

14. The apparatus of claim 13, wherein the driving motor is a stepping motor.

15. The apparatus of claim 13, wherein the nozzle supporting member consists of a disc portion at which the gear and a gear teeth are formed at the outer circumference; and a cylinder portion vertically extended from the disc portion, having the connection rod and rotatively supported by contacting to the second support roller.

16. A refrigerator having a concentrated cooling apparatus, comprising:

a cold air supply path formed at the rear of a chilling chamber and supplying air ventilated by a blower;

a cold air discharge duct installed at the upper portion of the chilling chamber and having plural cold air discharge holes communicating with the cold air supply path to discharge cold air into the chilling chamber;

plural cold air guide paths formed at the side wall of the chilling chamber so as to communicate with the cold air supply path in order to guide cold air to the side wall of the chilling chamber;

a nozzle rotatively installed at each cold air guide hole formed at the cold air guide paths respectively and jetting cold air intensively to a high-temperature load occurred region;

a temperature sensor installed at the front of the nozzle and sensing a high-temperature load occurred region while rotating with the nozzle; and a nozzle driving unit for rotating the nozzle.

17. The refrigerator of claim 16, wherein a damper is installed on the cold air supply path in order to open/close cold air flowing into the chilling chamber and open/close cold air supply to the cold air discharge duct.

18. The refrigerator of claim 17, wherein the damper is rotatively installed on the upper surface of the cold air supply path by a hinge shaft, and the hinge shaft is connected to a driving unit.

19. The refrigerator of claim 16, wherein each nozzle is vertically installed at the left wall of the chilling chamber at regular intervals.

20. The refrigerator of claim 16, wherein each nozzle is vertically installed at the right wall of the chilling chamber at regular intervals.

21. The refrigerator of claim 16, wherein each nozzle is vertically installed at the left and right walls of the chilling chamber at regular intervals.

22. The refrigerator of claim 16, wherein each nozzle is installed at a portion on the side wall of the chilling chamber near to a door.

* * * * *